US007263315B2

(12) United States Patent
Tanaka et al.

(10) Patent No.: US 7,263,315 B2
(45) Date of Patent: Aug. 28, 2007

(54) DEVELOPING APPARATUS HAVING PARTICULAR STRUCTURAL ARRANGEMENT OF DEVELOPER CARRYING MEMBERS

(75) Inventors: Shigeru Tanaka, Toride (JP); Kota Arimoto, Toride (JP); Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 11/183,978

(22) Filed: Jul. 19, 2005

(65) Prior Publication Data

US 2006/0029431 A1 Feb. 9, 2006

(30) Foreign Application Priority Data

Aug. 6, 2004 (JP) ..... 2004-231748

(51) Int. Cl.
*G03G 15/08* (2006.01)

(52) U.S. Cl. ..... 399/254; 399/256

(58) Field of Classification Search ..... 399/119, 399/254, 255, 256, 258, 259
See application file for complete search history.

(56) References Cited

U.S. PATENT DOCUMENTS 4,864,349 A * 9/1989 Ito ..... 399/256
5,160,968 A * 11/1992 Yamada et al. ..... 399/63

(Continued)

FOREIGN PATENT DOCUMENTS

JP 55-32060 3/1980

(Continued)

*Primary Examiner*—Robert Beatty
(74) *Attorney, Agent, or Firm*—Fitzpatrick, Cella, Harper & Scinto

(57) ABSTRACT

Provided is a developing apparatus, including: a developer carrying member for carrying a developer containing toner and a carrier; a first chamber having an opening in which the developer carrying member is disposed; a carrying member for carrying the developer in a longitudinal direction of the developer carrying member, the carrying member being disposed in the first chamber; a second chamber to which the developer is supplied from the first chamber through a first connection portion communicating with the first chamber and which supplies the developer to the first chamber through a second connection portion communicating with the first chamber; a spiral carrying member for agitating and carrying the developer by rotation, the spiral carrying member being obliquely disposed in the second chamber at an angle of 2° or more and 10° or less; and a developer replenishing apparatus for replenishing a developer for replenishment to a developer replenishment position in the second chamber, in which when a height with respect to a rotation axis of the spiral carrying member of an intersection of a circumference of the spiral carrying member and a developer surface in a first vertical plane on a downstream side of a developer carrying direction with respect to the developer replenishment position is denoted by Ha (mm) and a height with respect to the rotation axis of an intersection of the circumference of the spiral carrying member and the developer surface in a second vertical plane on a 50-mm downstream side of the first vertical plane in a direction of a horizontal direction component of the developer carrying direction is denoted by Hb (mm), Ha (mm) and Hb (mm) in a state where an attitude of the spiral carrying member in the first vertical plane and an attitude of the spiral carrying member in the second vertical plane are the same satisfy the relationship of Ha (mm)+2 (mm)≦Hb (mm).

4 Claims, 9 Drawing Sheets

U.S. PATENT DOCUMENTS

| | | | | |
|---|---|---|---|---|
| 5,175,586 | A | 12/1992 | Goseki et al. | 355/259 |
| 5,682,583 | A * | 10/1997 | Ito et al. | 399/254 |
| 5,842,090 | A * | 11/1998 | Mikawa | 399/256 |
| 6,324,369 | B1 * | 11/2001 | Yamaguchi et al. | 399/254 |
| 7,031,644 | B2 * | 4/2006 | Ikeda et al. | 399/254 |
| 7,046,945 | B2 * | 5/2006 | Nishitani et al. | 399/254 |
| 2005/0031381 | A1 | 2/2005 | Arimoto | 399/258 |
| 2006/0029432 | A1 | 2/2006 | Arimoto et al. | 399/254 |

FOREIGN PATENT DOCUMENTS

| | | |
|---|---|---|
| JP | 2003-5519 | 1/2003 |

* cited by examiner

DEVELOPING APPARATUS HAVING PARTICULAR STRUCTURAL ARRANGEMENT OF DEVELOPER CARRYING MEMBERS

BACKGROUND OF THE INVENTION

1. Field of the Invention

The present invention relates to a developing apparatus to be used in an image forming apparatus using an electrophotographic method or an electrostatic recording method such as a copying machine, a printer, or a facsimile.

2. Related Background Art

In an image forming apparatus using an electrophotographic method, especially an image forming apparatus forming an image having a chromatic color, a two-component development method involving the use of a mixture of non-magnetic toner (toner) and a magnetic carrier (carrier) as a developer has been conventionally widely used. The two-component development method has advantages over other development methods currently proposed such as the stability of image quality and the durability of an apparatus.

In a developing apparatus using the two-component development method (two-component developing apparatus), when toner is supplied to an image bearing member to perform development, the toner concentration in a developer (a ratio between toner and a carrier, or a ratio of toner to the entire developer) gradually reduces. New toner must be replenished in order to prevent the reduction in toner concentration. A two-component developer containing a carrier is supplied in some cases to replenish toner.

FIG. 7 shows a conventional general two-component developing apparatus. An example of the prior art document relating to such two-component developing apparatus includes Japanese Patent Application Laid-Open No. S55-32060.

A developing apparatus 101 has a developer container 102 for storing a developer. A portion of the developer container 102 opposed to an image bearing member as a member to be developer is opened. A developing sleeve 111 as a developer carrying member for supplying a developer to the image bearing member is rotatably disposed so as to be partially exposed from the opening. The developer container 102 has a developing chamber (a first developer storing chamber) 121 and an agitating chamber (a second developer storing chamber) 122. The developing chamber 121 is disposed along an axial direction of the developing sleeve 111, and the developer stored in the chamber is supplied to the developing sleeve 111. In the agitating chamber 122, the replenished toner and the developer in the developer container 102 are carried in a direction opposite to the developing chamber 121 while they are mixed and agitated. The developing chamber 121 and the agitating chamber 122 are partitioned by a partition wall 125. However, a first connection portion 123 and a second connection portion 124 permitting the passage of a developer are formed on both longitudinal ends of the partition wall 125. In addition, a first screw 113 and a second screw 114 are arranged as carrying members for carrying and agitating a developer (developer carrying and agitating members) in the developing chamber 121 and the agitating chamber 122, respectively. With this configuration, a developer circulating path is formed, in which a developer is circulated between the developing chamber 121 and the agitating chamber 122 through the first connection portion 123 and the second connection portion 124 (a direction indicated by an arrow D in the figure).

The developer container 102 is provided with a toner replenishment port for replenishing toner. At a toner replenishment position T, toner replenished to the developer container 102 as a result of falling by virtue of the force of gravity is agitated with the developer in the developer container 102 in the agitating chamber 122. Thus, the replenished toner contacts with a carrier to be frictionally charged.

However, when agitation in the agitating chamber 122 is insufficient, the developer is carried to the developing chamber 121 through the first connection portion 123 while the replenished toner is not sufficiently charged. Furthermore, when the insufficiently charged toner is used for a development operation, toner fog occurs on an image white portion (a region on an image bearing member to which toner should not adhere originally), so a reduction in image quality may occur.

To prevent such toner fog, it is sufficient that the replenished toner be sufficiently charged during carriage to the first connection portion 123. In the conventional developing apparatus 101, a distance L from the toner replenishment position T to the first connection portion 123 in the agitating chamber 122 (hereinafter, referred to as an "agitation distance") is appropriately set for sufficiently charging the replenished toner.

However, in the conventional developing apparatus 101, as a result of appropriately setting the agitation distance L for sufficiently frictionally charging toner replenished to the developer container 102, the agitation distance L has often been longer than the width of an electrostatic image to be formed on the image bearing member in a direction toward the longitudinal direction of the developer circulating path, that is, a development region (hereinafter, referred to as an "image formation width") G. In general, the image formation width G substantially corresponds to the length of a developing sleeve 211 in an axial direction (longitudinal direction).

For example, in the developing apparatus 101 shown in FIG. 7, the toner replenishment position T is placed on an upstream side of a developer carrying direction with respect to the image formation width G, whereby the agitation distance L necessary for sufficiently charging replenished toner is secured.

In general, the minimum length in the longitudinal direction requested for the developing apparatus 101 is very the image formation width G. However, in the developing apparatus 101 shown in FIG. 7, the agitation length L is longer than the image formation width G in order to sufficiently charge replenished toner during carriage of the toner to the first connection portion 123. As a result, a reduction in size of the developing apparatus 101 is inhibited, and a reduction in size of the entire image forming apparatus is inhibited.

With recent increasing needs for images having chromatic colors, not only a reduction in cost of an image forming apparatus forming an image having a chromatic color but also a reduction in size of the apparatus has been demanded as in the case of, for example, a monochromatic image forming apparatus according to an electrophotographic method.

An idea of improving an ability to charge replenished toner without any increase in the dimension of the developing apparatus 101 in the longitudinal direction as described above is, for example, as follows.

The carrying member 114 is obliquely disposed, a position on an upstream side of the developer carrying direction is lowered, and a position on a downstream side thereof is raised, so part of a developer back-flows owing to the force of gravity. Thus, the developer that has back-flown falls from above toner replenished to the developer container 102 and floating on the developer surface, whereby an ability to take the toner in the developer is improved. As a result, the replenished toner is quickly mixed with the developer, whereby an ability to charge toner can be improved.

However, under a more stringent condition, for example, when the replenished toner amount is large, when a large replenished toner amount continues for a long period of time, or when a developer deteriorates as a result of long-term use, a sufficient agitating ability is not obtained in some cases if the carrying member is merely obliquely disposed while the behavior of the developer surface in the developer container is not taken into consideration. Accordingly, an additional improvement of an ability to agitate a developer has been demanded.

The invention described in Japanese Patent Application Laid-Open No. 2003-5519 discloses a configuration in which a second screw 227 is arranged obliquely with respect to a first screw 226 as shown in FIGS. 8 and 9. In addition, in the developing apparatus described in Japanese Patent Application Laid-Open No. 2003-5519, a developer falling space 234 in which a developer carried by the first screw 226 falls into the second screw 227 is formed between an end portion of the first screw 226 on a downstream side of a developer carrying direction and an end portion of the second screw 227 on an upstream side of the developer carrying direction. In addition, an inclined plane 235 for guiding the developer to the second screw 227 is arranged below the developer falling space 234. The developer and replenished toner fall onto the inclined plane 235 through the developer falling space 234. Then, the developer and the replenished toner are overlaid and agitated on the inclined plane 235, slide along the inclined plane 235, and are carried to the end portion of the second screw 227 on the upstream side of the developer carrying direction. With this configuration, an improvement of, for example, the dispersibility of the replenished toner into the developer has been attempted. However, in the developing apparatus described in Japanese Patent Application Laid-Open No. 2003-5519, the second screw 227 is merely slanted with respect to the first screw 226 in order to secure the developer falling space 234. The developing apparatus described in Japanese Patent Application Laid-Open No. 2003-5519 has neither disclosure nor suggestion regarding an improvement of an ability of the second screw 227 to agitate a developer achieved by an appropriate back-flow of the developer carried by the second screw 227.

SUMMARY OF THE INVENTION

An object of the present invention is to provide a developing apparatus with an improved ability to agitate a developer achieved by a carrying member for agitating and carrying a developer in a developer container.

To achieve the above object, according to one aspect of the present invention, there is provided a developing apparatus, including:

a developer carrying member for carrying a developer containing toner and a carrier;

a first chamber having an opening in which the developer carrying member is disposed;

a carrying member for carrying the developer in a longitudinal direction of the developer carrying member, the carrying member being disposed in the first chamber;

a second chamber to which the developer is supplied from the first chamber through a first connection portion communicating with the first chamber and which supplies the developer to the first chamber through a second connection portion communicating with the first chamber;

a spiral carrying member for agitating and carrying the developer by rotation, the spiral carrying member being disposed in the second chamber, the spiral carrying member being disposed with its rotation axis slanted by 2° or more and 10° or less with respect to a horizontal direction in such a manner that the second connection portion is placed at a position higher than that of the first connection portion; and developer replenishing means for replenishing a developer for replenishment to a developer replenishment position in the second chamber, in which when a height with respect to the rotation axis of an intersection of a circumference of the spiral carrying member and a developer surface in a first vertical plane on a downstream side of a developer carrying direction with respect to the developer replenishment position is denoted by Ha (mm) and a height with respect to the rotation axis of an intersection of the circumference of the spiral carrying member and the developer surface in a second vertical plane on a 50-mm downstream side of the first vertical plane in a direction of a horizontal direction component of the developer carrying direction is denoted by Hb (mm), Ha (mm) and Hb (mm) in a state where an attitude of the spiral carrying member in the first vertical plane and an attitude of the spiral carrying member in the second vertical plane are the same satisfy the following relationship.

$$Ha\ (\mathrm{mm})+2\ (\mathrm{mm}) \leqq Hb\ (\mathrm{mm})$$

DESCRIPTION OF THE PREFERRED EMBODIMENTS

Hereinafter, a developing apparatus, a cartridge, and an image forming apparatus according to the present invention will be described in more detail with reference to the accompanying drawings.

Embodiment 1

(Entire Configuration and Operation of Image Forming Apparatus)

Figure 1:
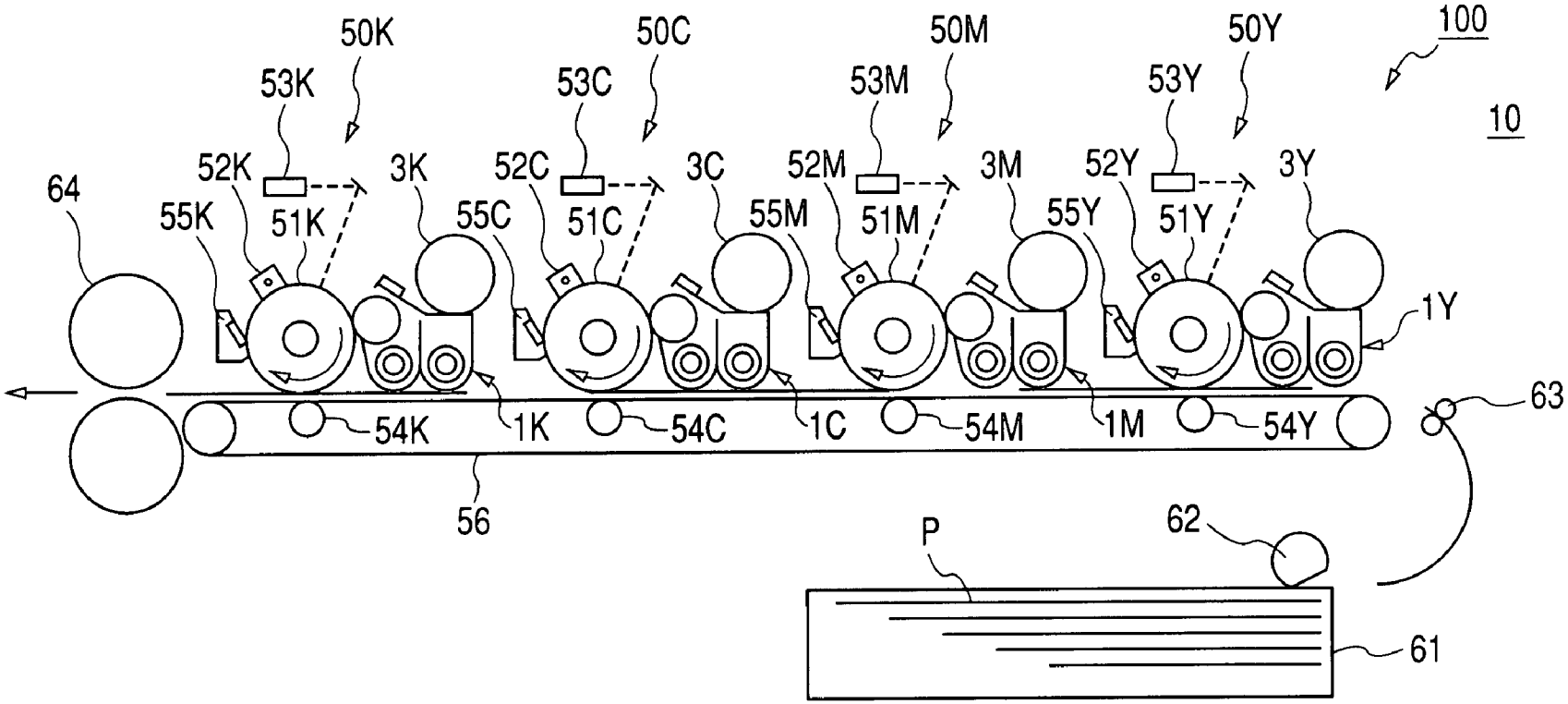
FIG. 1 is a schematic sectional view showing an example of an image forming apparatus to which the present invention is applicable.

First, the entire configuration and operation of an embodiment of an image forming apparatus to which the present invention is applicable will be described with reference to FIG. 1. FIG. 1 is a schematic sectional view of an embodiment of an image forming apparatus 100 to which the present invention is applicable.

The image forming apparatus 100 of this embodiment is a color electrophotographic image forming apparatus provided with 4 image forming portions 50Y, 50M, 50C, and 50K for forming images of respective colors (yellow (Y), magenta (M), cyan (C), and black (K)) as multiple image forming means. The image forming apparatus 100 can form a color image on a recording material P in accordance with an image information signal from: an external host device such as a personal computer communicably connected with an image forming apparatus main body 10; or an original reading apparatus attached to or communicably connected with the image forming apparatus main body 10.

First, the entire operation of the image forming apparatus 100 will be described. In this embodiment, the respective image forming portions 50Y, 50M, 50C, and 50K of the image forming apparatus 100 have basically the same configuration and form images having different colors. Accordingly, unless there is a particular need for distinguishing the image forming portions from one another, subscripts Y, M, C, and K attached to the symbols in the figure to show which image forming portion a component belongs to are omitted, and the image forming portions are collectively described.

Each of the image forming portions 50 has a drum type electrophotographic photosensitive member which is rotatable in a direction indicated by an arrow in the figure (hereinafter, referred to as the "photosensitive drum") as an image bearing member. At the time of image formation, the surface of the rotating photosensitive drum 51 is charged by a primary charging device 52 as charging means. The charged surface of the photosensitive drum 51 is subjected to scanning exposure by means of a laser scanner 53 as image writing means (exposing means) in accordance with an image information signal subjected to color separation corresponding to each image forming portion 50. Thus, an electrostatic image in accordance with the image information signal of a corresponding color is formed on the photosensitive drum 51. Then, the electrostatic image is developed with toner in a developing apparatus 1, so a toner image is formed on the photosensitive drum 51.

A conveying belt 56 as recording material conveying means is arranged to be opposed to the photosensitive drum 51 of each image forming portion 50 in such a manner that the belt is endlessly movable. In addition, a transfer charging device 54 as transferring means is arranged at a position opposed to the photosensitive drum 51 of each image forming portion 50 through the conveying belt 56. The toner image formed on the photosensitive drum 51 as described above is transferred onto the recording material P on the conveying belt 56 by a transferring bias applied by the transfer charging device 54.

The recording material P is conveyed from a cassette 61 as a recording material storing portion to a registration roller 63 by recording material supplying means such as a pick-up roller 62. Then, the recording material P is fed by the registration roller 63 to the conveying belt 56 so as to be in synchronization with an image formation operation in each image forming portion 50.

For example, when a full-color image is to be formed, such image formation operation as described above is performed in each image forming portion 50 for a yellow, magenta, cyan, or black color. Thus, toner images are sequentially transferred onto the recording material P conveyed on the conveying belt 56, whereby a desired full-color image is formed on the recording material P. At the time of formation of a monochromatic image, only an image forming portion for forming a desired color is used, whereby a toner image can be similarly formed on the recording material P.

After that, the recording material P is peeled off from the conveying belt 56, and is conveyed to a fixing apparatus 64. A toner image transferred onto the recording material P is pressed and heated by the fixing apparatus 64 to be a permanent image. Transfer residual toner remaining on the photosensitive drum 51 after the transfer is removed by a cleaning apparatus 55 as cleaning means to prepare for subsequent image formation. The cleaning apparatus 55 has a blade-like cleaning member.

(Developing Apparatus)

Next, the developing apparatus 1 will be described with reference to FIGS. 2 and 3.

The developing apparatus 1 has a developer container 2 for storing a developer. The developer container 2 stores, as a developer, a two-component developer mainly composed of non-magnetic toner (toner) and a magnetic carrier (carrier). An initial toner concentration in the developer is 7 wt % in this embodiment; provided, however, that the value should be properly adjusted in accordance with, for example, the charge amount of the toner, a carrier particle size, and the configuration of an image forming apparatus, and there is no need to follow the value at all times.

A part of the developer container 2 opposed to the photosensitive drum 51 is opened, and a developing sleeve 11 as a developer carrying member is rotatably disposed so as to be partially exposed from the opening. The developing sleeve 11 is composed of a non-magnetic material, and has a fixed magnet 12 as magnetic field generating means in it. In this embodiment, the magnet 12 has multiple magnetic poles along its outer periphery. Then, during a development operation, the developing sleeve 11 rotates in a direction indicated by an arrow, holds the two-component developer in the developer container 2 in a layer fashion, and carries the developer to a development region opposed to the photosensitive drum 51. The developer carried on the developer sleeve 11 forms a magnetic brush napping in the development region. The magnetic brush is brought into contact with or brought close to the surface of the photosensitive drum 51. Thus, the toner in the two-component developer is supplied to the photosensitive drum 51 in accordance with an electrostatic image formed on the surface of the photosensitive drum 51, whereby the electrostatic image is developed.

In general, at least during a development operation, a predetermined developing bias is applied to the developing sleeve 11, and toner is transported to the photosensitive drum 51 by an action of an electric field formed between the photosensitive drum 51 and the developing sleeve 11. In addition, developer amount regulating means 18 is arranged on an upstream side of the rotation direction of the developing sleeve 11 with respect to the development region in order to regulate the amount of the developer carried on the developing sleeve 11. The developer amount regulating means 18 cooperates with the magnet 12 to regulate the thickness of a developer layer by virtue of an action of a magnetic field.

After having developed the electrostatic image on the photosensitive drum 51, the developer is carried in accordance with the rotation of the developing sleeve 11 to be recovered in a developing chamber (a first developer storing chamber) 21 of the developer container 2 to be described later.

The developer container 2 is partitioned by a partition wall 25 into two chambers substantially equal in size: the developing chamber (the first developer storing chamber) 21 (close to the developing sleeve 11) and an agitating chamber (a second developer storing chamber) 22 (distant from the developing sleeve 11). In this embodiment, the developing chamber 21 and the agitating chamber 22 extend substantially parallel with the axial direction of the developing sleeve 11 when viewed from above as shown in FIG. 3. The partition wall 25 does not reach side walls 26 and 27 on both longitudinal ends of the inside of the developer container 2, whereby a first connection portion 23 and a second connection portion 24 permitting the passage of a developer between the developing chamber 21 and the agitating chamber 22 are formed.

The developing chamber 21 and the agitating chamber 22 are provided with circulating means for circulating a developer between the developing chamber 21 and the agitating chamber 22. The circulating means has a first screw 13 and a second screw 14 each serving as carrying means for carrying and agitating a developer along the longitudinal axis line directions of the developing chamber 21 and the agitating chamber 22. Those first and second screws 13 and 14 cause the developer to circulate while being mixed and agitated in the developer container 2. The direction of circulation of the developer in the developing apparatus 1 of this embodiment has a direction from the back of the paper surface of FIG. 2 to the front thereof in the developing chamber 21 and a direction from the front of the paper surface of FIG. 2 to the back thereof in the agitating chamber 22 (a direction indicated by an arrow D shown in FIG. 3).

The toner corresponding to an amount of toner consumed for image formation passes from a toner cartridge 3 through a replenishment port 33 and a reception port 17*a* of a developer replenishment mechanism 17 arranged in the developer container 2 to be carried into the developer replenishment mechanism 17. The toner in the toner cartridge 3 is carried to the developer replenishment mechanism 17 by the rotary force of an agitating member of the toner cartridge 3 and the force of gravity. Then, the toner in the developer replenishment mechanism 17 is replenished to the agitating chamber 22 of the developer container 2 through a replenishment port 17*b* in accordance with the rotation of a replenishment screw 17*c* as developer replenishing means of the developer replenishment mechanism 17. A replenished toner amount is determined on the basis of, for example, information on a consumed toner amount calculated (integrated) from concentration information for each pixel based on: a detection signal of a reflection type optical sensor 19 arranged as toner concentration detecting means in the developing apparatus 1; or an image information signal for each color. The replenishment screw 17*c* is driven in such a manner that a required amount of toner is replenished to the developer container 2 in accordance with the determined replenished toner amount.

Here, a developer to be used in this embodiment will be described. As described above, in this embodiment, a two-component developer mainly composed of non-magnetic toner (toner) and a magnetic carrier (carrier) is used.

In general, toner is composed of resin particles produced by pulverization or polymerization and having a colorant and the like mixed in a resin. The volume average particle size of the toner is about 5 to 15 μm. Any other fine particle additive is externally added as required to the toner. The toner to be used in this embodiment is negatively chargeable toner produced by using a polyester-based resin by means of pulverization, and has a volume average particle size of 7 μm. However, the toner is not necessarily limited to the configuration to obtain an effect of the present invention.

In general, the carrier is mainly composed of particles of ferrite or the like, or particles prepared by dispersing a magnetic material into a resin. The carrier is provided with a resin coating layer on its surface as required. The volume average particle size of the carrier is about 20 to 70 μm. In this embodiment, a carrier having a volume average particle size of 50 μm prepared by coating the surface layer of ferrite as a core with a silicone resin was used. However, the carrier is not necessarily limited to the configuration to obtain an effect of the present invention.

(Circulating Path of Developer)

Next, a circulating path of the developer in the developer container 2 will be described.

Figure 2:
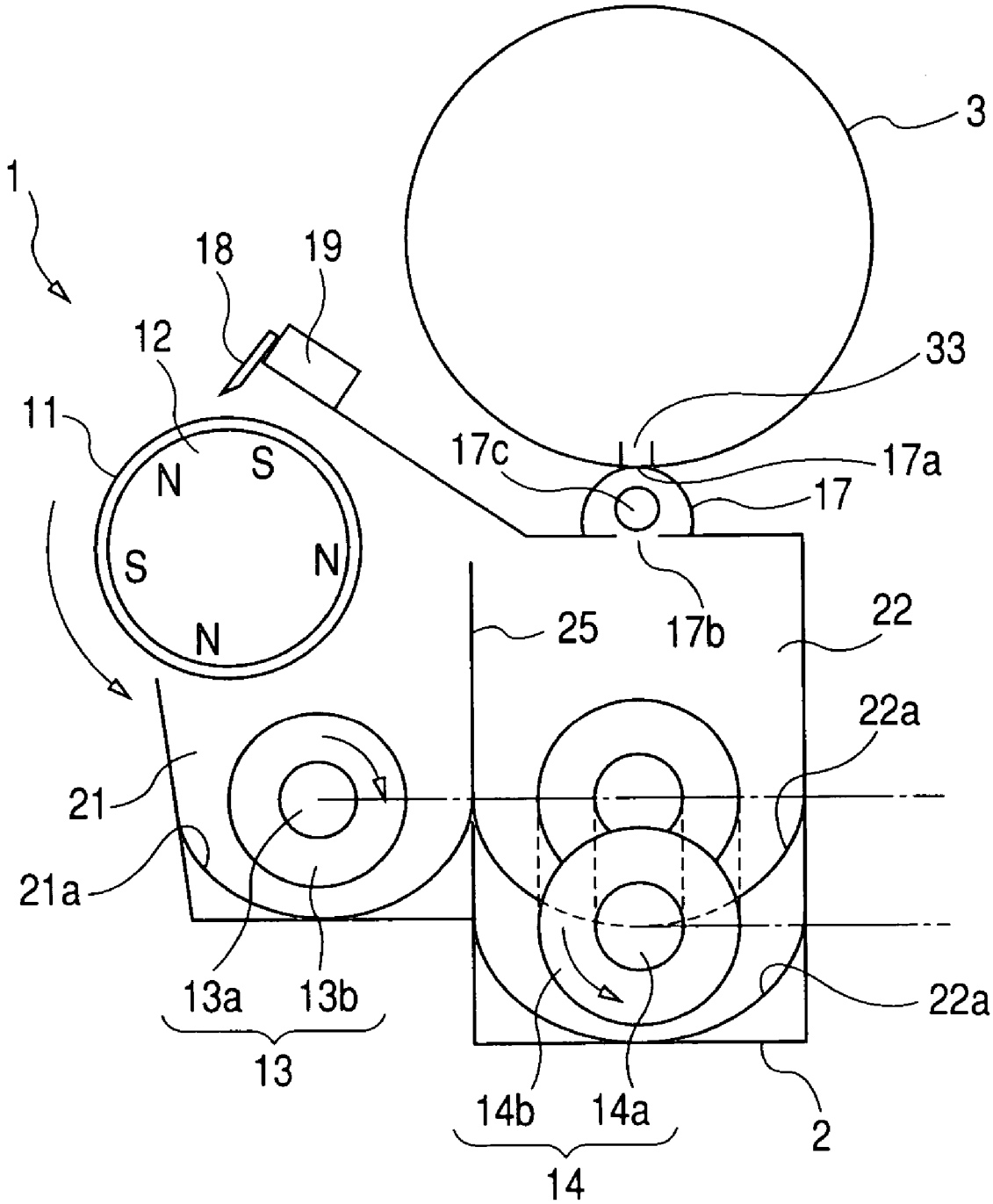
FIG. 2 is a schematic sectional view of an embodiment of a developing apparatus according to the present invention.
Figure 3:
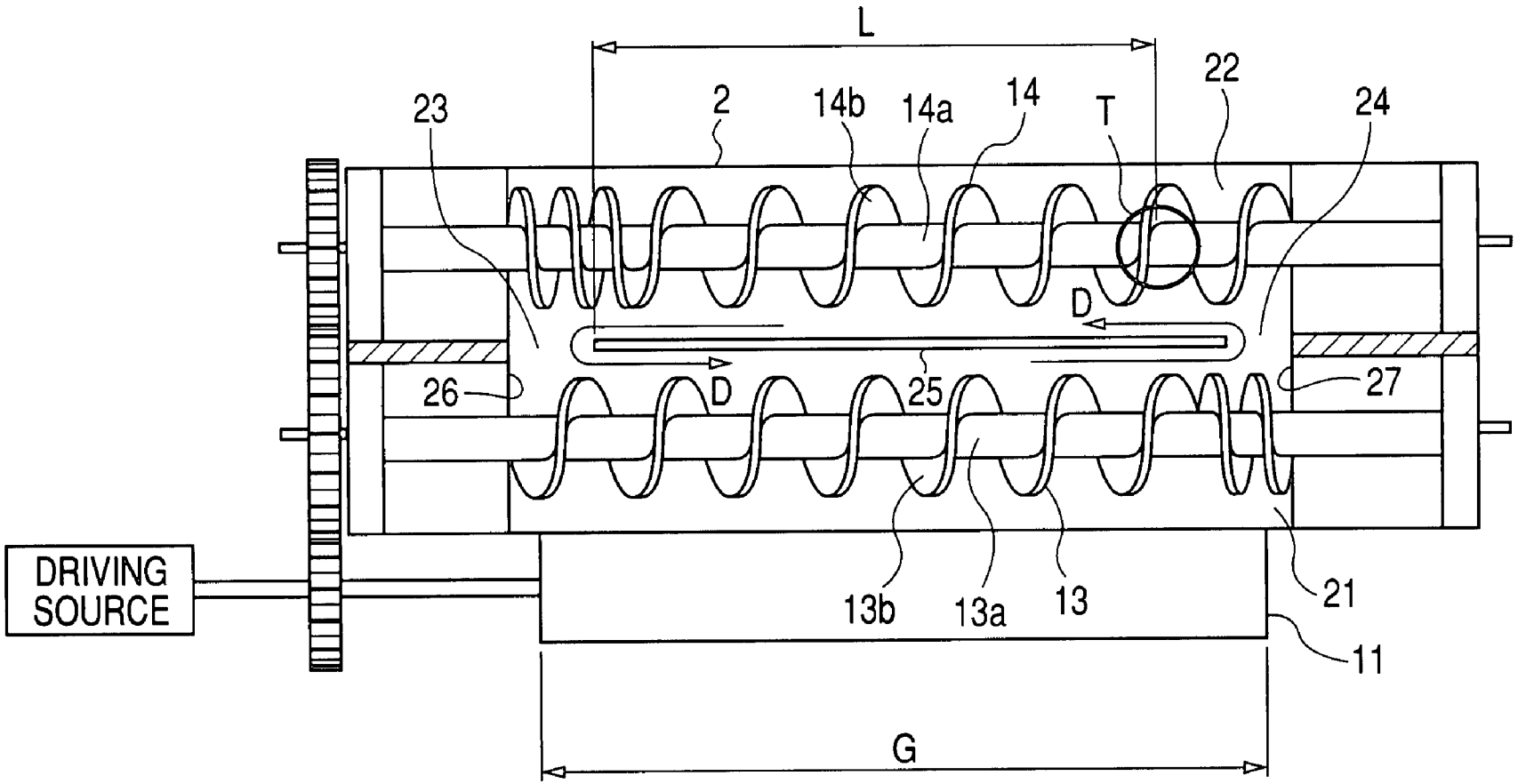
FIG. 3 is a top view of the embodiment of the developing apparatus according to the present invention.

Referring to FIGS. 2 and 3, in this embodiment, the first screw 13 and the second screw 14 have rotation axes 13*a* and 14*a* arranged substantially parallel with the longitudinal axis line directions of the developing chamber 21 and the agitating chamber 22 and spiral carrying portions (blade portions, spiral members) 13*b* and 14*b* arranged around the rotation axes, respectively.

In this embodiment, the axial radius of each of the rotation axes 13*a* and 14*a* of the first and second screws 13 and 14 (the radius of each of the rotation axes 13*a* and 14*a* when the first and second screws 13 and 14 are viewed in the directions of the rotation axes: hereinafter, simply referred to as the "radius of a rotation axis", too) is 3 mm. Moreover, the spiral carrying portions 13*b* and 14*b* each having a radius (the radius of a circumscribed circle formed by rotation of each of the spiral carrying portions 13*b* and 14*b* when the first and second screws 13 and 14 are viewed in the directions of the rotation axes: hereinafter, simply referred to as the "radius of a carrying portion", too) of 8 mm are arranged on the peripheral surfaces of the rotation axes 13*a* and 14*a* at intervals of 20 mm in the directions of the rotation axes. In addition, the number of revolutions of the first screw 13 is 250 rpm, while the number of revolutions of the second screw 14 is 420 rpm. In this embodiment, the first screw 13 rotates clockwise in FIG. 2, while the second screw 14 rotates counterclockwise in FIG. 2.

In the developing apparatus 1 of this embodiment, the agitating chamber 22 (more specifically, a bottom surface (bottom portion) 22*a* of the agitating chamber 22) is slanted upward by 5° with respect to a horizontal direction from an upstream side of a developer carrying direction to a downstream side thereof (a climbing gradient from the second connection portion 24 to the first connection portion 23). Accordingly, the agitating chamber 22 is in a twisted positional relationship with respect to the developing sleeve 11. In addition, the rotation axis 14*a* of the second screw 14 is disposed substantially parallel with the bottom surface 22*a* of the agitating chamber 22, and is disposed in the agitating chamber 22 with a slant of 5° with respect to the horizontal direction (a climbing gradient from the upstream side of the developer carrying direction to the downstream side thereof).

A slant having a climbing gradient from the upstream side of the developer carrying direction in the agitating chamber 22 to the downstream side thereof (the direction indicated by the arrow D in the figure) is arranged, whereby a force having a gravity direction component opposite to the developer carrying direction in the agitating chamber 22 is generated, thereby causing part of the developer to back-flow.

Meanwhile, in this embodiment, the developing chamber 21 (more specifically, a bottom surface (bottom portion) 21*a* of the developing chamber 21) is disposed in a substantially horizontal direction, that is, substantially, parallel with the developing sleeve 11 for stable supply of a developer to the entire longitudinal area of the developing sleeve 11. Furthermore, the rotation axis 13*a* of the first screw 13 is disposed substantially parallel with the bottom surface 21*a* of the developing chamber 21, and is disposed substantially horizontally.

According to the investigation conducted by the inventors of the present invention, the slant of the agitating chamber 22 with respect to the horizontal direction or the slant of the rotation axis 14*a* of the screw 14 with respect to the horizontal direction is preferably 2° to 10°. That is, an angle Θ formed between the agitating chamber 22 (its bottom surface 22*a*) or the rotation axis 14*a* of the second screw 14 and the horizontal direction (a direction perpendicular to the gravity direction) preferably satisfies the following relationship. Experimental results for the slant Θ of the agitating chamber will be described later.

$$2° \leqq \Theta \leqq 10° \quad (1)$$

In general, the agitating chamber 22 and the rotation axis 14*a* of the second screw 14 are disposed substantially parallel with each other, and hence the angle formed between the agitating chamber 22 and the horizontal direction and the angle formed between the second screw 14 and the horizontal direction are assumed to be the same. Accordingly, those angles are collectively referred to as the "slant Θ (°) of the agitating chamber".

In the present specification, orientations of components of the developing apparatus 1 such as the developing chamber 21 and the agitating chamber 22 are compared with the horizontal direction (or a vertical direction perpendicular thereto) in normal usage states of the developing apparatus 1 (the developer container 2) and the image forming apparatus 100. Typically, in the normal usage states of the developing apparatus 1 (the developer container 2) and the image forming apparatus 100, the entire longitudinal axis line direction of the developing apparatus 1 (the developer container 2) (the longitudinal axis line direction of the developing sleeve 11) corresponds to the horizontal direction; provided, however, that the longitudinal axis line direction does not strictly mean the horizontal direction and may be shifted from the horizontal direction to the extent that no problems occur in the normal use of the developing apparatus 1 (the developer container 2) or of the image forming apparatus 100.

In this embodiment, the bottom surface 22*a* of the agitating chamber 22 and the bottom surface 21*a* of the developing chamber 21 are at the same position in the vertical direction in the first connection portion 23 for delivering a developer from the agitating chamber 22 to the developing chamber 21. On the other hand, the bottom surface 22*a* of the agitating chamber 22 is placed at a position in the vertical direction lower than that of the bottom surface 21*a* of the developing chamber 21 in the second connection portion 24 for delivering the developer from the developing chamber 21 to the agitating chamber 22.

Therefore, both the bottom surfaces 21*a* and 22*a* are at the same position in the vertical direction in the first connection portion 23, so the developer can be smoothly delivered from the agitating chamber 22 to the developing chamber 21. In the second connection portion 24 as well, the developer can be smoothly delivered as a result of a falling operation of the developer from the developing chamber 21 to the agitating chamber 22.

In the developing apparatus 1 of this embodiment, the image formation width G is 305 mm, and the longitudinal length of each of the developing chamber 21 and the agitating chamber 22 is similarly 305 mm.

Furthermore, the toner replenishment position T in the developing apparatus 1 of this embodiment is a position downstream by 10 mm of the second connection portion 24 arranged at one longitudinal end of each of the developing chamber 21 and the agitating chamber 22.

(Developer Surface S in Agitating Chamber)

Next, a developer surface S in the agitating chamber 22 characteristic of this embodiment will be described with reference to FIGS. 4A to 4C and FIG. 5. The developer surface S means an interface formed between the developer stored in the developer container 2 and an internal space of the developer container 2.

In this embodiment, property of agitating a developer is improved by using a gravity component in a direction opposite to the developer carrying direction in the agitating chamber 22. Furthermore, the attraction of toner floating on the developer surface into the developer is aided by the developer back-flowing from the downstream side of the developer carrying direction. In general, in this embodiment, a drop in developer surface is arranged in the developer carrying direction in the agitating chamber 22 in addition to the slant of the rotation axis 14*a* of the second screw 14. More specifically, the heights of the developer surface S are specified at two points in the developer carrying direction in the agitating chamber 22, that is, a predetermined first vertical plane V1 and a predetermined second vertical plane V2 to be described later. The term "vertical" as used herein refers to a gravity direction.

Figure 4A:
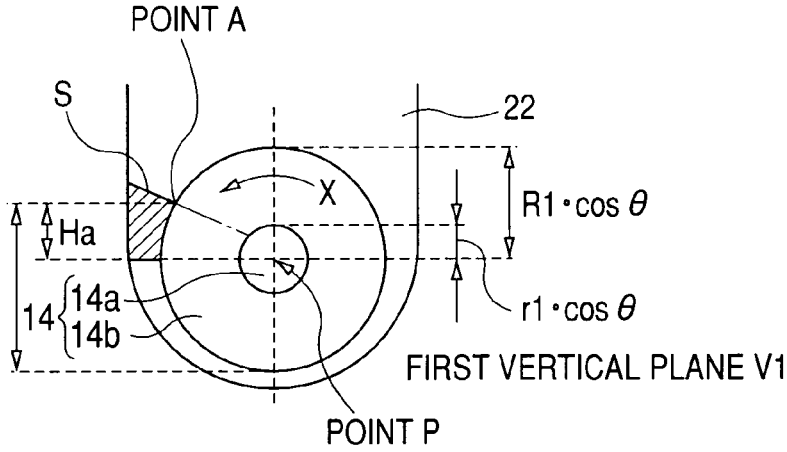
FIGS. 4A, 4B, and 4C are each a longitudinal sectional view of an agitating chamber showing a relationship between a developer surface and a carrying member in the agitating chamber, which is a characteristic part of the present invention.
Figure 4B:
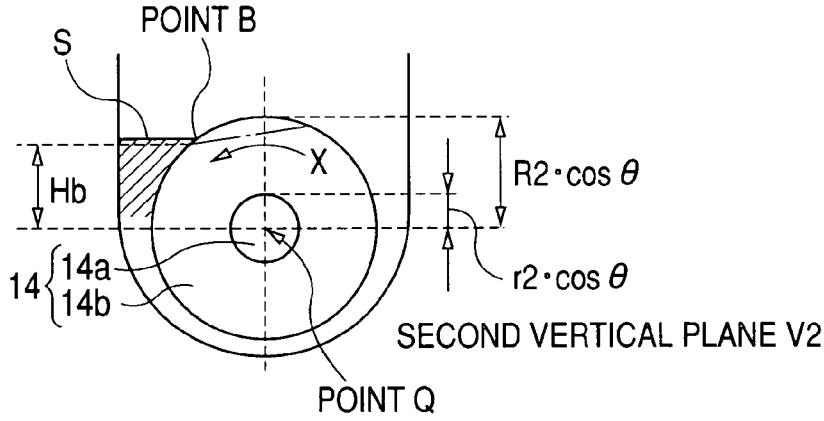
Figure 4C:
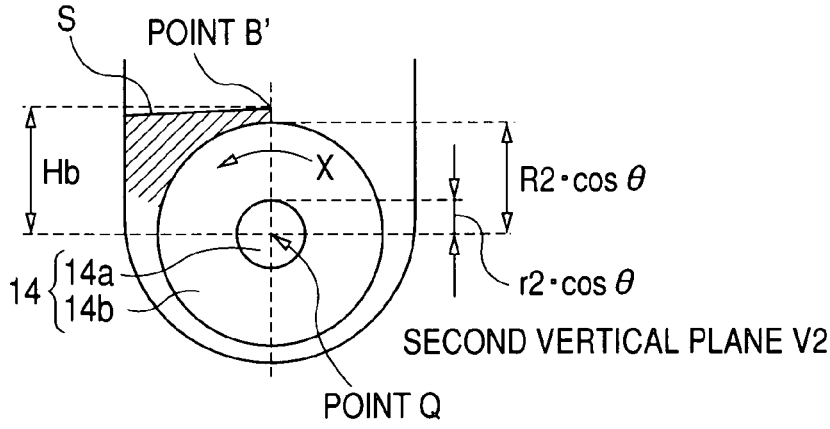

FIGS. 4A to 4C are each a vertical sectional view of the agitating chamber 22 showing the states of the developer surface S and the second screw 14. In FIGS. 4A to 4C, the developer carrying direction is a direction from the front of the paper surface to the back thereof. A dash-dotted line indicates the developer surface S pressed in the developer carrying direction by the spiral carrying portion 14*b* of the second screw 14. In addition, a solid line indicates the developer surface S that can be seen from a point of view. Furthermore, an oblique line portion below the developer surface S indicated by solid lines indicates the developer that can be seen from the point of view.

Figure 5:
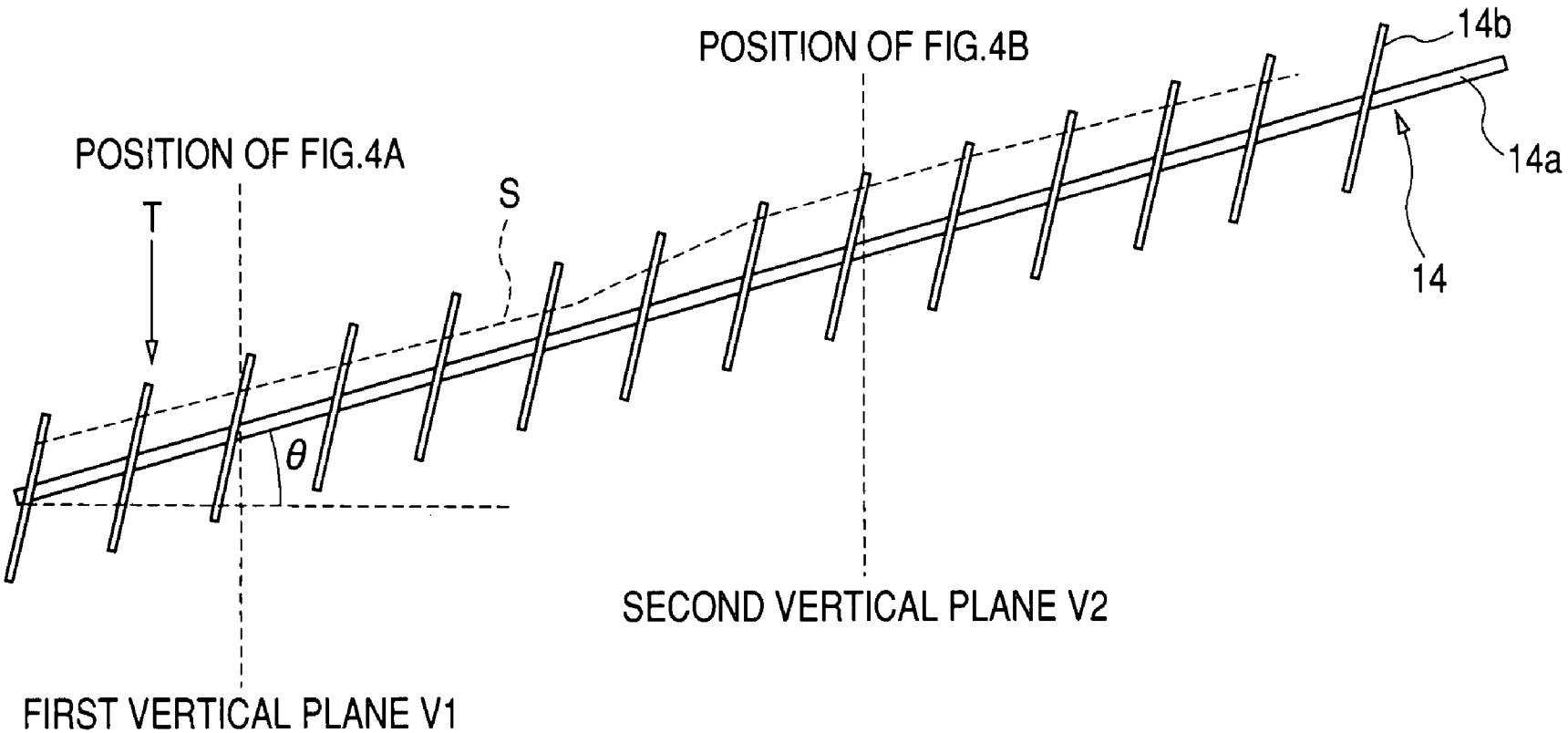
FIG. 5 is a lateral sectional view of the agitating chamber showing the relationship between the developer surface and the carrying member in the agitating chamber.

FIG. 5 shows the states of the second screw 14 and the developer surface S in the agitating chamber 22 when the agitating chamber 22 is seen from the side opposite to the developing sleeve 11.

FIGS. 4A and 4B respectively show vertical sections at two points in the developer carrying direction, that is, the first vertical plane V1 and the second vertical plane V2.

A figure obtained by developing a circumscribed circle formed by the rotation of the carrying portion 14*b* when the second screw 14 is viewed in the axial direction into the first vertical plane V1 (that is, the gravity direction) at a position on the first vertical plane V1, that is, the section of the cylinder formed by the rotation of the second screw 14 at the first vertical plane V1 is an ellipse having a long-side (a lateral direction in the figure, that is, the horizontal direction) radius (longer radius) of R1 (mm) and a short-side (a longitudinal direction in the figure, that is, the vertical direction) radius (shorter radius) of R1·cos Θ (mm).

A figure obtained by developing the circumscribed circle formed by the rotation of the carrying portion 14*b* when the second screw 14 is viewed in the axial direction into the second vertical plane V2 (that is, the gravity direction) at a position on the second vertical plane V2, that is, the section of the cylinder formed by the rotation of the second screw 14 at the second vertical plane V2 is an ellipse having a long-side (a lateral direction in the figure, that is, the horizontal direction) radius (longer radius) of R2 (mm) and a short-side (a longitudinal direction in the figure, that is, the vertical direction) radius (shorter radius) of R2·cos Θ (mm).

Similarly, a figure formed by the rotation of the rotation axis 14*a* at the first/second vertical plane V1/V2 is an ellipse having a long-side (a lateral direction in the figure) radius of r1/r2 (mm) and a short-side (a longitudinal direction in the figure) radius of r1·cos Θ/r2·cos Θ (mm).

The first vertical plane V1 and the second vertical plane V2 are indicated by dashed lines in FIG. 5.

(First Vertical Plane V1 and Second Vertical Plane V2)

Here, the first vertical plane V1 and the second vertical plane V2 are defined as follows.

First, the first vertical plane V1 and the second vertical plane V2 are placed on the downstream side of the developer carrying direction with respect to the toner replenishment position T of the agitating chamber 22.

The first vertical plane V1 and the second vertical plane V2 include any one of the following points in a region in which the second screw 14 moves downward as a result of its rotation with respect to a vertical line including the rotation axis 14*a* of the second screw 14 in each of the first vertical plane V1 and the second vertical plane V2.

When an intersection of a tip of the spiral carrying portion 14*b* of the second screw 14 and the developer surface S exists, the first vertical plane V1 and the second vertical plane V2 include the intersection. As described in detail later, FIG. 4A shows the section of the agitating chamber 22 when viewed in a direction perpendicular to the first vertical plane V1 including an intersection (a point A) of the carrying portion 14*b* and the developer surface S, while FIG. 4B shows the section of the agitating chamber 22 when viewed in a direction perpendicular to the second vertical plane V2 including an intersection (a point B) of the carrying portion 14*b* and the developer surface S.

When no intersection of the tip of the spiral carrying portion 14*b* of the second screw 14 and the developer surface S exists, that is, when the developer surface S exceeds the maximum height in the vertical direction of the spiral carrying portion 14*b* of the second screw 14 in the plane, the first vertical plane V1 and the second vertical plane V2 include the following point. In this case, the planes include a point (fictitious intersection) directly above the rotation axis 14*a* in the vertical direction when the tip of the spiral carrying portion 14*b* of the second screw 14 is placed directly above the rotation axis 14*a* of the second screw 14 in the vertical direction. As described in detail later, FIG. 4C shows the section of the agitating chamber 22 when viewed in a direction perpendicular to the second vertical plane V2 not including the intersection of the carrying portion 14*b* and the developer surface S. FIG. 4C shows the case where the second vertical plane V2 does not include the intersection of the carrying portion 14*b* and the developer surface S. Similarly, when the first vertical plane V1 does not include the intersection of the carrying portion 14*b* and the developer surface S, a fictitious intersection can be determined as described above.

(Height Ha of Developer Surface S in First Vertical Plane V1)

FIG. 4A shows the states of the developer surface S and the second screw 14 in the first vertical plane V1 at a position about 20 mm horizontally away from the toner replenishment position T toward downstream of the developer carrying direction.

The second screw 14 rotates counterclockwise as indicated by an arrow X in the figure. Therefore, replenished toner is mixed and agitated with a developer by the rotation of the second screw 14 on a left side of the figure with respect to a center position P of the rotation axis 14*a*. In other words, in the first vertical plane V1, in a region in which the second screw 14 moves downward as a result of its rotation with respect to the vertical line including the rotation axis 14*a* of the second screw 14, the replenished toner is mixed and agitated with the developer by the rotation of the second screw 14. The point A in the figure is the intersection of the tip of the carrying portion 14*b* of the second screw 14 and the developer surface S. Since the amount of toner carried by the screw differs pitch by pitch of the screw, the intersection moves vertically in the first vertical plane V1 in association with the rotational period of the screw.

The carrying portion 14*b* of the second screw 14 carries the developer while extruding it in the developer carrying direction. However, in the region indicated by the oblique line portion on the left side of the point A in the figure, the developer surface S exceeds the carrying portion 14*b*. The part of the developer receives a force in a gravity direction corresponding to the installation angle of the second screw 14 (5° in this embodiment). Therefore, the part of the developer moves toward the front of the paper surface in the figure, that is, in the direction opposite to the developer carrying direction.

Here, the distance in the vertical direction of the point A from the center position P of the rotation axis 14*a* of the second screw 14 in the first vertical plane V1 is defined as the height Ha (mm) of the point A. The height Ha (mm) of the point A varies depending on the rotational period of the screw because of the reason described above. As shown in FIG. 4A, the height Ha of the point A in the case where the point A is placed above the rotation axis 14*a* of the second screw 14 in the vertical direction is provided with a plus sign (the plus sign may be omitted), and the height of the point A in the case where the point A is placed below the rotation axis 14*a* of the second screw 14 in the vertical direction is provided with a minus sign. As described above, the height Ha in the first vertical plane V1 varies depending on the rotational phase of the screw (the attitude of the screw). In this embodiment, attention is paid to the height of the point A when the phase in the rotation direction of the screw is a predetermined angle. In the measurement of this embodiment, the height Ha of the point A is 3 mm.

That is, the definition of the height Ha is as follows.

In a region in the first vertical plane V1 in which a screw member moves downward as a result of its rotation, when an intersection of the tip of the screw and a developer surface exists, the height Ha is the height of the intersection A with respect to the rotation axis of the screw, and has a value at the time when the phase in the rotation direction of the screw is a predetermined angle. When no intersection exists, the height Ha is the height of a fictitious intersection as the developer surface directly above the rotation axis of the screw in the vertical direction with respect to the rotation axis of the screw, and has a value at the time when the phase in the rotation direction of the screw is the predetermined angle.

(Height Hb of Developer Surface S in Second Vertical Plane V2)

FIG. 4B shows the states of the developer surface S and the second screw 14 in the second vertical plane V2 at a position about 50 mm horizontally away from the first vertical plane V1 toward downstream of the developer carrying direction (that is, about 70 mm horizontally away from the toner replenishment position T toward downstream of the developer carrying direction).

The second screw 14 rotates counterclockwise as indicated by an arrow X in the figure. Therefore, replenished toner is mixed and agitated with a developer by the rotation of the second screw 14 on a left side of the figure with respect to a center position Q of the rotation axis 14*a*. In other words, in the second vertical plane V2, in a region in which the second screw 14 moves downward as a result of its rotation with respect to the vertical line including the rotation axis 14*a* of the second screw 14, the replenished toner is mixed and agitated with the developer by the rotation of the second screw 14. The point B in the figure is the intersection of the tip of the carrying portion 14*b* of the second screw 14 and the developer surface S.

As in the case of FIG. 4A, the carrying portion 14*b* of the second screw 14 carries the developer while extruding it in the developer carrying direction. However, in the region indicated by the oblique line portion on the left side of the point B in the figure, the developer surface S exceeds the carrying portion 14*b*. The part of the developer receives a force in a gravity direction corresponding to the installation angle of the second screw 14 (5° in this embodiment). Therefore, the part of the developer moves toward the front of the paper surface in the figure, that is, in the direction opposite to the developer carrying direction.

Here, the distance in the vertical direction of the point B from the center position Q of the rotation axis 14*a* of the second screw 14 in the second vertical plane V2 is defined as the height Hb (mm) of the point B. The height Hb (mm) of the point B varies depending on the rotational period of the screw because of the reason described above. As shown in FIG. 4B, the height Hb of the point B in the case where the point B is placed above the rotation axis 14*a* of the second screw 14 in the vertical direction is provided with a plus sign (the plus sign may be omitted), and the height Hb of the point B in the case where the point B is placed below the rotation axis 14*a* of the second screw 14 in the vertical direction is provided with a minus sign. As described above, the height Hb in the second vertical plane V2 varies depending on the rotational phase of the screw (the attitude of the screw). In this embodiment, attention is paid to the height of the point B when the phase in the rotation direction of the screw at which the attitude of the screw in the second vertical plane is the same as the attitude of the screw in the first vertical plane is the predetermined angle. In the measurement of this embodiment, the height Hb of the point B is 7 mm. In other words, in this embodiment, the height Hb-max of the point B is higher than the height Ha-max of the point A by 4 mm.

That is, the definition of the height Hb is as follows.

In a region in the second vertical plane V2 in which a screw member moves downward as a result of its rotation, when an intersection of the tip of the screw and a developer surface exists, the height Hb is the height of the intersection B with respect to the rotation axis of the screw; provided, however, that the height has a value at the time when the phase in the rotation direction of the screw at which the attitude of the screw in the second vertical plane is the same as the attitude of the screw in the first vertical plane is the predetermined angle. When no intersection exists, the height Hb is the height of a fictitious intersection as the developer surface directly above the rotation axis of the screw in the vertical direction with respect to the rotation axis of the screw, and has a value at the time when the phase in the rotation direction of the screw is the predetermined angle (see FIG. 4C).

(Ability to Attract Developer)

As described above, a drop in the developer surface S is arranged in the developer carrying direction in the agitating chamber 22 in addition to the slant of the rotation axis 14*a* of the second screw 14, whereby a phenomenon in which the developer back-flows while exceeding the carrying portion 14*b* can be efficiently obtained. As a result, toner floating on the developer surface S without being attracted into the developer is allowed to crawl under the developer surface S by the developer back-flowing from a position on the downstream side of the developer carrying direction. Thus, an aiding effect on an ability to attract replenished toner into a developer can be obtained.

Here, a distance Dv in the horizontal direction between the first vertical plane V1 and the second vertical plane V2 is set to 50 mm. Then, it was found that the height Hb of the point B at this time must be higher than the height Ha of the point A by 2 mm or more. That is, the following relationship must be satisfied.

$$Ha\ (\text{mm})+2\ (\text{mm}) \leqq Hb\ (\text{mm}) \tag{2}$$

(provided that the distance Dv in the horizontal direction between the first vertical plane V1 and the second vertical plane V2 is 50 mm)

As shown more specifically in experimental results to be described later, in the case where the height of the point B when the distance Dv in the horizontal direction between the first vertical plane V1 and the second vertical plane V2 is set to be in the above range is lower than that defined by the expression (2), an improving effect of the present invention on an ability to impart charge to toner of the second screw 14 under a stringent condition, for example, when the replenished toner amount is large, when a large replenished toner amount continues for a long period of time, or when a developer deteriorates as a result of long-term use cannot be obtained.

A direction in which the developer surface S raises in the second vertical plane V2 is taken into consideration. As shown in FIG. 4C, the case where the developer surface S exceeds the maximum height in the vertical direction of the carrying portion 14*b* in the section can be assumed. The height of the developer surface S in this case is determined as follows. In this case, the second vertical plane V2 includes, as a fictitious intersection B', the developer surface S directly above the rotation axis 14*a* when the tip of the carrying portion 14*b* of the second screw 14 is placed directly above the rotation axis 14*a*. In other words, a point directly above the highest point in a circumscribed circle formed by the rotation of the spiral carrying portion 14*b* when the second screw 14 is viewed in the axial direction in the section is considered to be a substitute for the intersection B (the fictitious intersection B'). The height of the fictitious intersection B' instead of the point B is considered to be the height Hb.

Even in the case where, in the first vertical plane V1, the developer surface S exceeds the maximum height in the vertical direction of the carrying portion 14*b* in the section, a fictitious intersection A' is assumed in the same manner as that described above, and the height of the fictitious intersection A' instead of the point A is considered to be the height Ha.

Next, the conditions under which an effect of the present invention becomes more remarkable will be described on the basis of experimental results.

(Experimental Conditions)

An experiment was performed by using a developer after a duration test corresponding to 50,000 pages had been performed in the image forming apparatus 100 under conditions of A4 size and an image ratio (a ratio of an image area to an A4 solid image) of 5%. In the duration test, as usual, toner corresponding to an amount of toner consumed for image formation was replenished by the developer replenishment mechanism 17.

Each of the developing apparatuses 1Y, 1M, 1C, and 1K of the image forming portions 50Y, 50M, 50C, and 50K for yellow (Y), magenta (M), cyan (C), and black (K) colors was used alone to perform the experiment. In this embodiment, the developing apparatuses 1 for the respective colors have substantially the same configuration except that colors to be developed are different from one another. The developing apparatuses 1 for the respective colors had the same experimental result.

The slant Θ of the agitating chamber 22 with respect to the horizontal direction (a climbing gradient from the second connection portion 24 to the first connection portion 23) was changed to 1°, 2°, 5°, 10°, and 12°, and circulation property was observed with the eyes.

The result confirmed that: when Θ=1°, the flow in the direction opposite to the developer carrying direction is weak, and the effect of the present invention is small; and when Θ=12°; the force having a gravity direction component increases, so it may be difficult to bring the circulation of the developer into a desired state under some experimental conditions to be described later, and it is difficult to stably obtain the effect of the present invention. Therefore, the slant Θ of the agitating chamber 22 is preferably in the range of 2° to 10°. That is, the slant Θ of the agitating chamber 22 preferably satisfies the following relationship.

$$2° \leqq \Theta \leqq 10° \quad (1)$$

Next, under a condition of Θ=2° where the effect of the present invention might appear most hardly in the range for establishing circulation, the following experiment was performed while the height Ha of the point A and the height Hb of the point B each representing the position of the developer surface S were changed by the amount of a developer to be charged into the developer container 2 and the numbers of revolutions of the first screw 13 and the second screw 14.

The point of measurement of the height Ha of the point A was a position about 20 mm horizontally away from the toner replenishment position T toward downstream of the developer carrying direction, while the point of measurement of the height Hb of the point B was a position about 70 mm horizontally away from the toner replenishment position T toward downstream of the developer carrying direction (that is, about 50 mm horizontally away from the point A toward downstream of the developer carrying direction).

In measuring the height of the developer surface S, the developing apparatus 1 in a state of carrying a developer is stopped at a timing where an agitating screw is at a desired position, to thereby perform measurement.

The developer container 2 that had been subjected to such duration test as described above was replenished with 2 g of toner at the toner replenishment position T, and was evaluated for the following two properties A and B.

Property A: performance of attracting replenished toner (visually observed)

Property B: charge amount distribution in the second connection portion 24 of a developer containing replenished toner If toner before being attracted into a two-component developer has a chromatic color, it has an apparently vivid color as compared to the two-component developer, so whether replenished toner is attracted and dispersed into the two-component developer can be visually observed. Even in the case of black toner, the toner before being attracted and dispersed and the two-component developer can be distinguished from each other with the eyes because they are different from each other in gloss.

The property A, the performance of attracting replenished toner, was evaluated as follows. The time required for tone replenished during driving of the developing apparatus 1 to be attracted into a two-component developer in a region between the point A and the point B was measured with the eyes. The case where the replenished toner disappeared from the surface of the two-component developer (that is, the toner was attracted into the two-component developer) within 30 seconds from the replenishment was defined as a good case (o), and the case where the replenished toner disappeared 30 seconds or longer after the replenishment was defined as a bad case (x).

The property B, the charge amount distribution, was evaluated as follows. A charge amount distribution was measured by means of an E-Spart Analizer manufactured by Hosokawamicron Corporation. The case where substantially all toner was of negative polarity was defined as a good case (o), and the case where the amount of toner that was not frictionally charged (a charge amount of zero) or the amount of toner having positive polarity increased was defined as a bad case (x). Table 1 shows the results.

TABLE 1

| Ha (mm) | Hb (mm) | Property A | Property B |
|---|---|---|---|
| −6 | −6, −4 | ○ | x |
| −4 | −4, −2 | ○ | x |
| −3 | −3, −2 | ○ | x |
| | −1 ~ +20 | ○ | ○ |
| +4 | +4, +5 | ○ | x |
| | +6 ~ +20 | ○ | ○ |
| +5 | +5, +7 | x | ND |
| +6 | +6, +8 | x | ND |

The above experimental results show that, as described above, the height Hb of the point B must satisfy the expression (2).

$$Ha\ (\text{mm}) + 2\ (\text{mm}) \leqq Hb\ (\text{mm}) \quad (2)$$

(provided that the distance Dv in the horizontal direction between the first vertical plane V1 and the second vertical plane V2 is 50 (mm))

When the height of the point B is lower than that defined by the expression (2), that is, a drop in the developer surface S in the developer carrying direction is smaller than that defined by the expression (2), an ability to attract replenished toner into a developer is obtained, but an ability to charge the attracted toner by means of a carrier in the developer is poor. When the drop in the developer surface S in the developer carrying direction is larger than that defined by the expression (2), it may be difficult to bring the circulation of a developer into a desired state. This is probably because an effect cannot be obtained in which toner floating on the developer surface is allowed to crawl under the developer by the developer back-flowing from the downstream side of the developer carrying direction as well as a gravity component generated by the slant of the rotation axis 14*a* of the second screw 14. Owing to this, an improving effect of the present invention on an ability to impart charge to toner of the second screw 14 under a stringent condition, for example, when the replenished toner amount is large, when a large replenished toner amount continues for a long period of time, or when a developer deteriorates as a result of long-term use cannot be obtained.

The above experimental results further show the following.

Here, in this embodiment, the radius of a circumscribed circle formed by the rotation of the spiral carrying portion 14*b* of the second screw 14 when the second screw 14 is viewed in the axial direction (the radius of the carrying portion 14*b*) is 8 mm. The radius of the rotation axis 14*a* when the second screw 14 is viewed in the axial direction (the radius of the rotation axis 14*a*) is 3 mm.

Accordingly, when the radius of a circumscribed circle formed by the rotation of the spiral carrying portion 14*b* of the second screw 14 around a point in the first/second vertical plane V1/V2 when the second screw 14 is viewed in the axial direction is denoted by R1/R2 (mm), R1 (mm)=R2 (mm)=8 mm is established. When the radius of the rotation axis 14*a* of the second screw 14 at a point in the first/second vertical plane V1/V2 when the second screw 14 is viewed in the same manner as described above is denoted by r1/r2 (mm), r1 (mm)=r2 (mm)=3 mm is established.

Properly speaking, the axial direction of the second screw 14 is slanted by an angle Θ of 2° with respect to the horizontal plane, so a figure formed by the rotation of the second screw 14 appearing in the first/second vertical plane V1/V2 is an ellipse having a long-side (a lateral direction in each of FIGS. 4A to 4C) radius of R1/R2 (mm) and a short-side (a longitudinal direction in each of FIGS. 4A to 4C) radius of R1·cos Θ/R2·cos Θ (mm). However, when Θ=2°, the value of cos Θ is equal to 0.999, which is within the error range in the description of this experiment.

As can be understood from the above experiment, the mixing and agitation behavior of toner replenished to a developer differs depending on the height Ha of the point A. The reason for the difference will be described in detail below.

(i) In the case where the point A is placed more than 5 mm below the lowermost point of the second screw 14 in the vertical direction:

In this case, that is, in this embodiment, the radius R1 of the carrying portion 14*b* is 8 mm. Therefore, in the case where the height Ha of the point A is lower than −3 mm, an ability to attract replenished toner into a developer is high, but an ability to charge the attracted toner by means of a carrier in the developer is poor because the amount of the developer near the point is small.

(ii) In the case where the point A is placed 5 mm or less below the lowermost point of the second screw 14 in the vertical direction but exceeds a point 4 mm above the center position P of the rotation axis 14*a* of the second screw 14 in the vertical direction:

In this case, that is, in this embodiment, the radius R1 of the carrying portion 14*b* is 8 mm. As a result, the height Ha of the point A is equal to or higher than −3 mm, and an ability to charge attracted toner by means of a carrier in a developer is high as compared to the case (i). However, an ability to attract replenished toner into a developer slightly decreases. In particular, when the replenished toner amount is large, or when the charging ability itself of a carrier reduces, a sufficient ability to impart charge cannot be obtained.

Here, as described above, the height of the developer surface S is, in a precise sense, compared with the height of the carrying portion 14*b* in the first/second vertical plane V1/V2, that is, the radius R1·cos Θ/R2·cos Θ in the longitudinal direction (vertical direction) of the ellipse appearing in the first/second vertical plane V1/V2.

In other words, as can be understood from the above experimental results, the following relationship is more preferably satisfied.

$$5\ (\mathrm{mm}) - R1 \cdot \cos\Theta (\mathrm{mm}) \leqq Ha\ (\mathrm{mm}) \leqq 4\ (\mathrm{mm}) \quad (3)$$

With regard to the height Hb of the point B, no condition under which the effect of the present invention was lost was found when the slant Θ of the agitating chamber 22 was 2°. In view of the above, an experiment similar to that described above was performed again with the slant Θ of the agitating chamber 22 changed to 10°. As a result, it was difficult to stably establish a condition under which the height Hb of the point B exceeded 15 mm+R2·cos Θ (mm) (that is, in this embodiment, 22.9 mm (=15 mm+7.9 mm (R2×cos Θ))])

This is probably because, when the position in the second vertical plane V2 defined as the point of measurement of the height Hb of the point B this time or a height corresponding to the height Hb of the point B on the downstream side of the developer carrying direction with respect to the second vertical plane V2 exceeds 15 mm+R2·cos Θ (mm), the amount of back-flow of the developer is so large that the developer surface S is apt to vary. Accordingly, the height Hb of the point B in the second vertical plane V2 and the height corresponding to the height Hb on the downstream side of the developer carrying direction with respect to the second vertical plane V2 does not preferably exceed 15 mm+R2·cos Θ (mm).

The above experiment was performed with the radii (R1 and R2) of the spiral carrying portion 14*b* of the second screw 14 set to 8 mm. A similar result was obtained when a similar experiment was performed with the radii (R1 and R2) set to 5 mm to 15 mm.

On the other hand, it is not preferable that each of the radii (R1 and R2) of the carrying portion 14*b* be less than 5 mm because the amount of a developer in the developing apparatus 1 reduces, and hence compatibility between performance of attracting toner and an ability to impart charge requested in the present invention is hardly achieved. It is not preferable either that each of the radii (R1 and R2) of the carrying portion 14*b* exceed 15 mm because the size of the developing apparatus 1 itself increases, although the effect of the present invention can be obtained.

In other words, the following relationships are preferably satisfied. It should be noted that, in general, R1=R2.

$$5\ (\text{mm}) \leqq R1 \leqq 15\ (\text{mm}) \quad (4)$$

$$5\ (\text{mm}) \leqq R2 \leqq 15\ (\text{mm}) \quad (5)$$

In the agitating chamber of the developing apparatus of this embodiment, a developer surface height that satisfies the condition represented by the expression (2) can be achieved by an appropriate relationship between the return length of a return member 14*c* and the opening width of the first connection portion 23. The return member 14*c* is arranged on the downstream side of the developer carrying direction of the second screw 14 so as to carry a developer in the direction opposite to a developer circulating direction.

$$Ha\ (\text{mm})+2\ (\text{mm}) \leqq Hb\ (\text{mm}) \quad (2)$$

Figure 10:
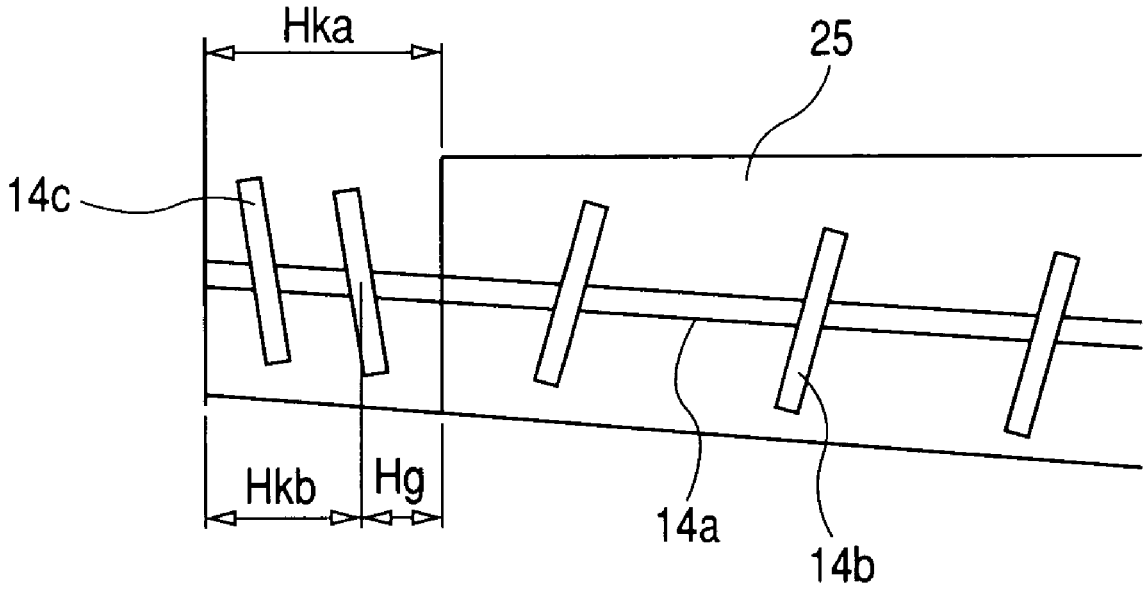
FIG. 10 is an enlarged view of the vicinity of a second connection portion in the present invention.

FIG. 10 is a view for explaining the relationship between the return length and the opening width. A return length Hkb is a distance from a side surface of the developer container 2 to the rotation center of the return member 14*c* which is most upstream of the developer carrying direction. An opening width Hka is a distance from the side surface of the developer container 2 to the partition wall 25. Table 2 shows a relationship among the return length Hka, the opening width Hkb, a developer coating state on the developing sleeve 11, and a developer surface state in the agitating chamber 22. A carrying gap Hg is a difference (Hka−Hkb) between the opening width and the return length. The return member 14*c* of the second screw 14 used in this experiment has a pitch interval of 5 mm, a return length of 5 mm is formed by one roll of a return member, and a return length of 10 mm is formed by two rolls of a return member. In addition, the developer coating state is evaluated as follows. The case where the developing sleeve 11 is evenly coated with a developer corresponds to o, while the case where the developing sleeve 11 is not evenly coated corresponds to x. The developer surface state is evaluated as follows. The case where the condition represented by the expression (2) of the present invention is satisfied in the agitating chamber 22 corresponds to o, while the condition is not satisfied corresponds to x.

TABLE 2

| Return length Hkb (mm) | Opening width Hka (mm) | Carrying gap Hg (mm) | Developer coating state | Developer surface state |
|---|---|---|---|---|
| 5 | 6, 8 | 1, 3 | x | o |
| | 10, 12, 14 | 5, 7, 9 | o | o |
| | 16, 18 | 11, 13 | o | x |
| 10 | 11, 13 | 1, 3 | x | o |
| | 15, 17, 19 | 5, 7, 9 | o | o |
| | 21, 23 | 11, 13 | o | x |

As can be seen from Table 2, irrespective of the return length Hkb, the developing sleeve 11 is not evenly coated with a developer when the carrying gap Hg is equal to or less than 3 mm. This is because the amount of a developer to be supplied to the developing chamber 21 through the first connection portion 23 significantly reduces owing to the small carrying gap. Furthermore, when the carrying gap is equal to or larger than 11 mm, the developer surface state cannot be a desired state. This is because, owing to the large carrying gap, the amount of a developer to be supplied to the developing chamber 21 through the first connection portion 23 increases and no retention of the developer on the downstream side of the developer carrying direction in the agitating chamber occurs. In other words, the carrying gap is desirably 5 to 9 mm in order to simultaneously achieve a state in which the developing sleeve is evenly coated with a developer and a desired developer surface state.

As described above, according to this embodiment, not only an improving effect on property to agitate a developer by means of a gravity component in a direction opposite to a developer carrying direction but also an aiding effect on attraction of toner by means of a developer back-flowing on a downstream side of the developer carrying direction while the force with which the toner is attracted into the developer is held in the developer carrying direction can be obtained. As a result, property of the second screw 14 to impart charge to toner is improved, and white fog hardly occurs even under a more stringent condition, for example, when a replenished toner amount is large or when a developer is used for a long period of time. In this case, even if the agitation length L is relatively short, toner replenished from the toner replenishment position T to the first connection portion 23 can be sufficiently charged. Typically, the agitation length L can be made equal to or shorter than the image formation width G.

As described above, according to this embodiment, a function of a carrying member for agitating and carrying a developer in the developer container 2 of agitating the developer can be improved. More specifically, according to this embodiment, property of imparting charge to toner can be improved and white fog hardly occurs even under a more stringent condition, for example, when a replenished toner amount is large or when a developer is used for a long period of time without any unnecessary increase in size of a developing apparatus or of an image forming apparatus provided with the developing apparatus.

Embodiment 2

Next, another embodiment of the present invention will be described. In an image forming apparatus of this embodiment, a process cartridge is detachably attachable to an image forming apparatus main body 10. The basic configuration and operation of the image forming apparatus of this embodiment are the same as those of Embodiment 1. Accordingly, components having substantially identical or corresponding functions and configurations as those of the image forming apparatus of Embodiment 1 are represented by the same reference symbols, and detailed description thereof is omitted.

Figure 6:
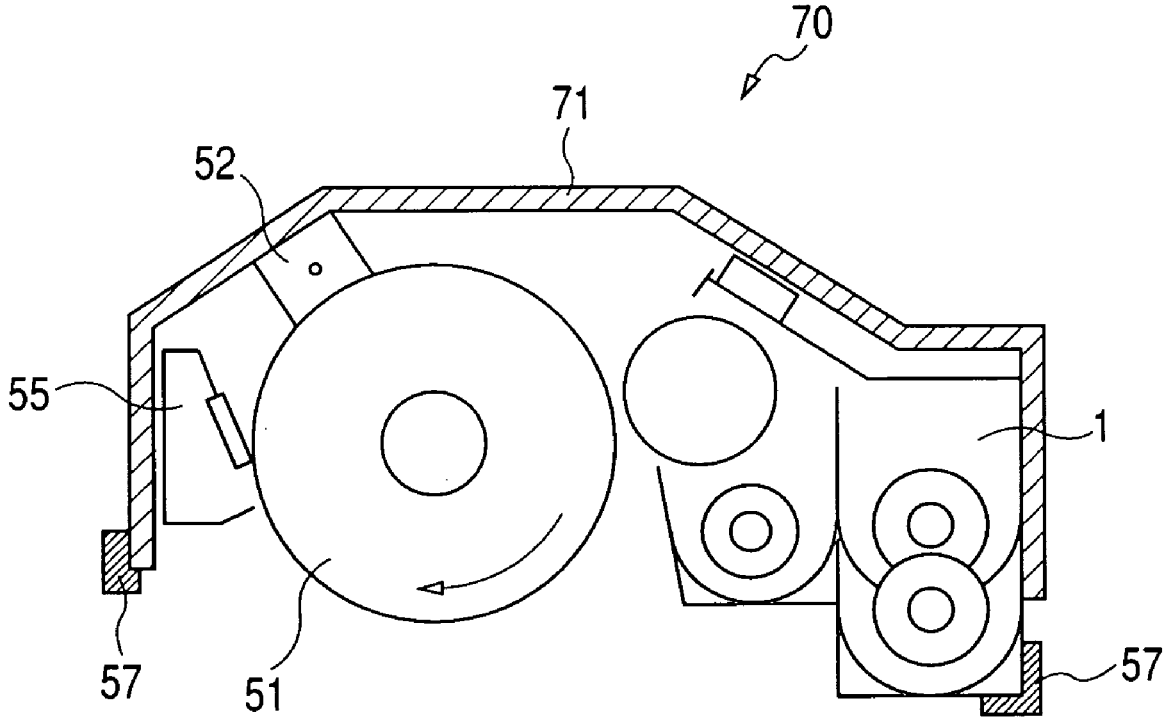
FIG. 6 is a schematic sectional view of an embodiment of a cartridge according to the present invention.
Figure 7:
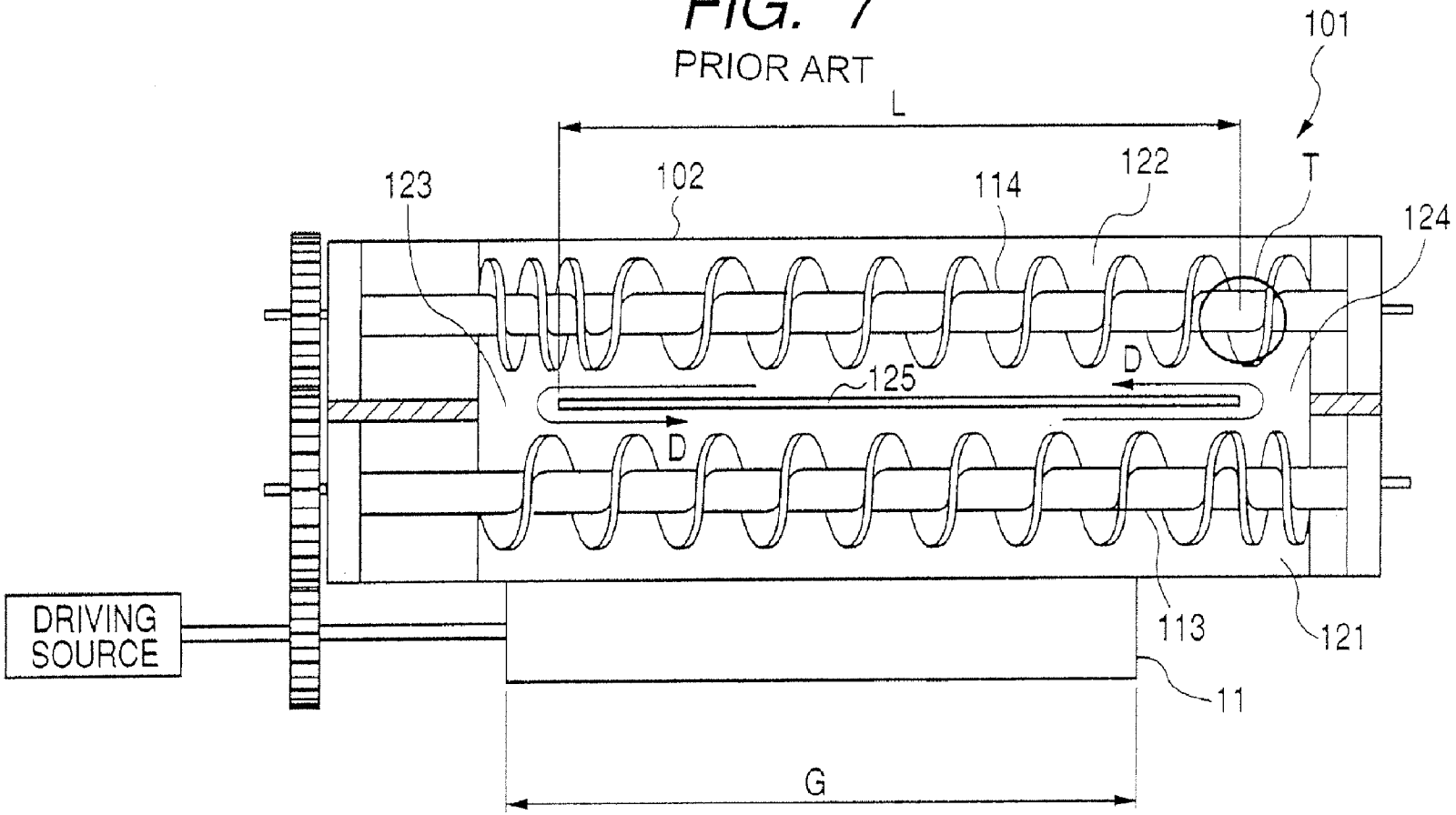
FIG. 7 PRIOR ART
FIG. 7 is a top view of an example of a conventional developing apparatus.
Figure 8:
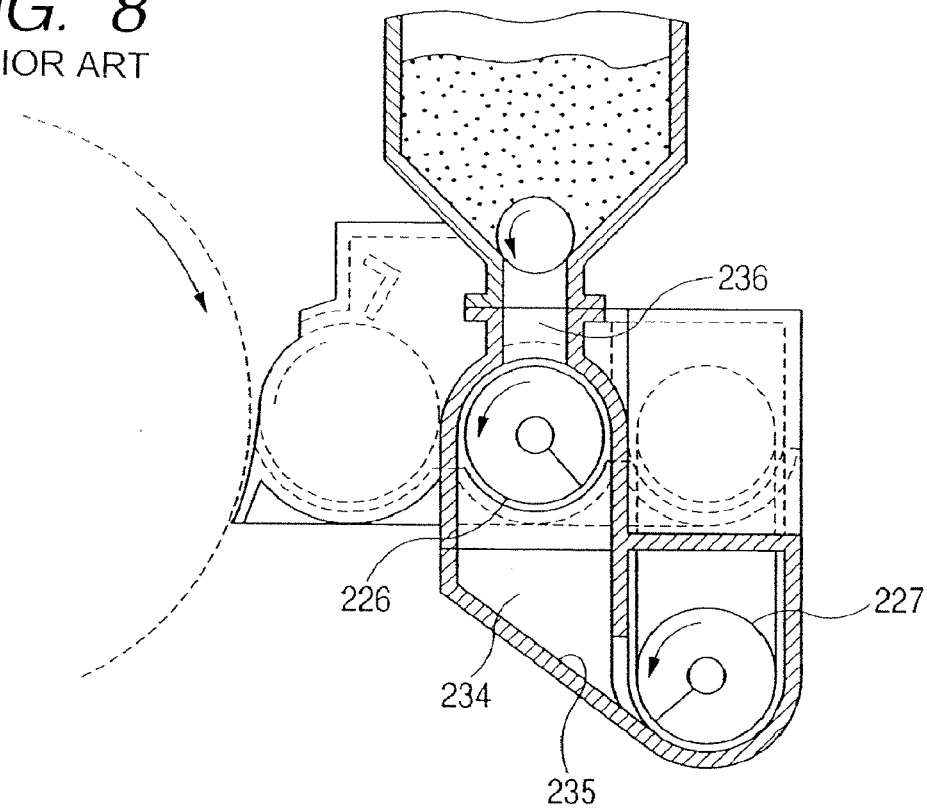
FIG. 8 PRIOR ART
FIG. 8 is a longitudinal sectional view of another example of the conventional developing apparatus.
Figure 9:
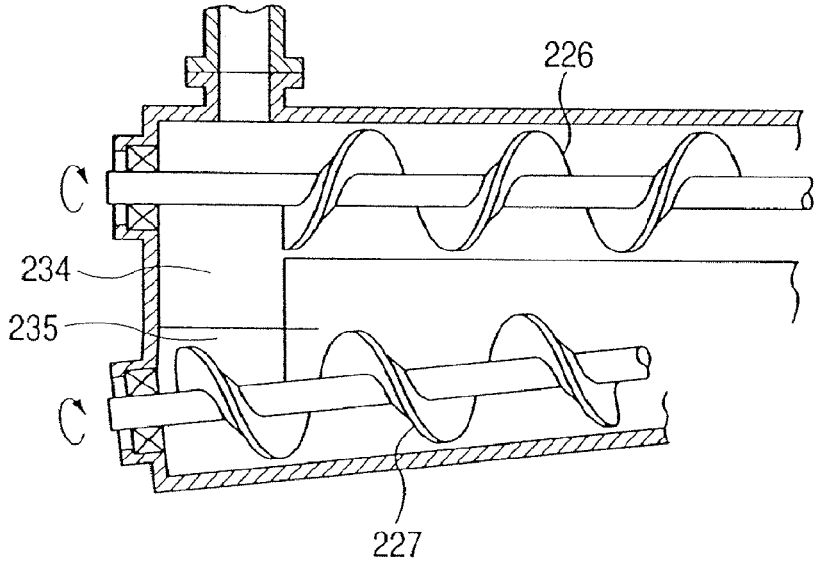
FIG. 9 PRIOR ART
FIG. 9 is a lateral sectional view of another example of the conventional developing apparatus.

FIG. 6 is a schematic sectional view of a process cartridge 70 of this embodiment. The process cartridge 70 of this embodiment includes a photosensitive drum 51, a primary charging device 52, a cleaning apparatus 55, and a developing apparatus 1, which are integrally stored in a frame 71. The configuration of the developing apparatus 1 is the same as that described in Embodiment 1.

The process cartridge 70 is detachably mounted on the image forming apparatus main body 10 via cartridge mounting means 57 of the image forming apparatus main body 10 such as a mounting guide or a positioning member.

In general, the entire process cartridge 70 is detached from the image forming apparatus main body 10 when the photosensitive drum 51 reaches its end of life or when a developer in the developing apparatus 1 significantly deteriorates. Then, a new process cartridge 70 is mounted on the image forming apparatus main body 10, whereby the image forming apparatus can be returned to its original state. Thus, the ease of maintenance can be improved. With this high ease of maintenance, a user himself or herself can exchange an apparatus without reliance on a service person having expertise to exchange an apparatus. In addition, a reduction in running cost of the image forming apparatus can be achieved by a reduction in labor cost.

The process cartridge 70 of this embodiment has the same configuration as that of Embodiment 1. Therefore, the process cartridge 70 of this embodiment can also provide the same effect as that of Embodiment 1. In particular, property of imparting charge to toner can be improved without any increase in size of the process cartridge 70.

The configuration of the process cartridge is not limited to that of the above embodiment. In other words, the configuration of the process cartridge may be appropriately determined while the ease of maintenance by a user, the lifetime of each component, and the like are taken into consideration. An electrophotographic photosensitive member and at least one of charging means, developing means, and cleaning means as process means acting on the electrophotographic photosensitive member have only to be integrated to provide a cartridge that is detachably attachable to an image forming apparatus main body. In addition, a cartridge that is detachably attachable to an image forming apparatus main body is not limited to the above process cartridge. A single developing apparatus may be a unit (developing cartridge) that is detachably attachable to an image forming apparatus main body. In this case as well, a reduction in size of a developing cartridge can be achieved as in the case of the above embodiment.

The present invention has been described above on the basis of the embodiments. However, the configuration with which the effect of the present invention can be obtained is not necessarily limited to those of the above embodiments. Various modes can be achieved in the scope of the condition shown in the present invention according to the configurations of the developing apparatus 1, the image forming apparatus 100, and the like. For example, in each of the above embodiments, the developer container 2 is replenished with toner corresponding to an amount of toner consumed for image formation. However, the present invention is not limited thereto. For example, a carrier may be discharged little by little from the developer container 2 to replace a deteriorated carrier with a new carrier. In such case, a carrier can be replenished together with toner.

This application claims priority from Japanese Patent Application No. 2004-231748 filed Aug. 6, 2004 which is hereby incorporated by reference herein.

What is claimed is:

1. A developing apparatus, comprising:

a developer carrying member for carrying a developer containing toner and a carrier;

a first chamber having an opening in which said developer carrying member is disposed;

a carrying member for carrying the developer in a longitudinal direction of said developer carrying member, said carrying member being disposed in said first chamber;

a second chamber to which the developer is supplied from said first chamber through a first connection portion communicating with said first chamber and which supplies the developer to said first chamber through a second connection portion communicating with said first chamber;

a spiral carrying member for agitating and carrying the developer by rotation, said spiral carrying member being disposed in said second chamber, said spiral carrying member being disposed with its rotation axis slanted by 2° or more and 10° or less with respect to a horizontal direction in such a manner that a portion opposite to the second connection portion is higher than a portion opposite to the first connection portion; and developer replenishing means for replenishing a developer for replenishment to a developer replenishment position in said second chamber, wherein, when a height with respect to the rotation axis of an intersection of a circumference of said spiral carrying member and a developer surface in a first vertical plane on a downstream side of a developer carrying direction with respect to the developer replenishment position is denoted by Ha (mm) and a height with respect to the rotation axis of an intersection of the circumference of said spiral carrying member and the developer surface in a second vertical plane on a 50 (mm) downstream side of the first vertical plane in a direction of a horizontal direction component of the developer carrying direction is denoted by Hb (mm), Ha (mm) and Hb (mm) in a state where an attitude of said spiral carrying member in the first vertical plane and an attitude of said spiral carrying member in the second vertical plane are the same satisfy the following relationship:

$$Ha\ (\text{mm})+2\ (\text{mm}) \leqq Hb\ (\text{mm}).$$

2. A developing apparatus according to claim 1, wherein, when a radius of a circular shape formed by intersection of the first vertical plane and an outermost circumference formed by rotation of said spiral carrying member is denoted by R1 (mm) and a radius of a circular shape formed by intersection of the second vertical plane and the outermost circumference formed by rotation of said spiral carrying member is denoted by R2 (mm) and an angle formed between the rotational axis and the horizontal direction, R1 (mm) and R2 (mm) satisfy the following relationships:

$$5\ (\text{mm}) - R1 \cdot \cos\Theta(\text{mm}) \leqq Ha\ (\text{mm}) \leqq 4\ (\text{mm}), \text{ and}$$

$$Hb\ (mm) \leqq 15\ \text{mm} + R2 \cdot \cos\Theta(\text{mm}).$$

3. A developing apparatus according to claim 2, wherein R1 (mm) and R2 (mm) satisfy the following relationships:

$$5\ (\text{mm}) \leqq R1 \leqq 15\ (\text{mm}), \text{ and}$$

$$5\ (\text{mm}) \leqq R2 \leqq 15\ (\text{mm}).$$

4. A developing apparatus according to claim 1, wherein:

said spiral carrying member includes, in a predetermined region ranging from a most downstream side of the developer carrying direction to the upstream side of the carrying direction, a spiral portion opposite in direction to a spiral portion at a position in the second vertical plane; and when an opening width in the second connection portion in a horizontal direction is denoted by Hka (mm) and a distance in a horizontal direction in the predetermined region is denoted by Hkb (mm), Hka (mm) and Hkb (mm) satisfy the following relationships:

$$\text{Hkb}\ (\text{mm}) \leqq \text{Hka}\ (\text{mm}), \text{ and}$$

$$5\ (\text{mm}) \leqq \text{Hka}\ (\text{mm}) - \text{Hkb}\ (\text{mm}) \leqq 9\ (\text{mm}).$$

* * * * *

UNITED STATES PATENT AND TRADEMARK OFFICE

CERTIFICATE OF CORRECTION

PATENT NO. : 7,263,315 B2
APPLICATION NO. : 11/183978
DATED : August 28, 2007
INVENTOR(S) : Shigeru Tanaka et al.

It is certified that error appears in the above-identified patent and that said Letters Patent is hereby corrected as shown below:

COLUMN 2:
Line 45, “very” should be deleted.

COLUMN 3:
Line 3, “toner replenished” should read --toner which is replenished--; and
Line 4, “floating” should read --is floating--.

COLUMN 9:
Line 15, “substantially,” should read --substantially--.

COLUMN 10:
Line 30, “property of agitating” should read --a property of agitating--.

COLUMN 14:
Line 39, “satisfied.” should read --satisfied:--; and
Line 45, “50 mm)” should read --50 mm).--.

COLUMN 15:
Line 41, “observed with the eyes” should read --visually observed--; and
Line 56, “appear most hardly” should read --be least--.

COLUMN 16:
Line 44, “Analizer” should read --Analyzer--; and
Line 65, “expression (2).” should read --expression (2):--.

COLUMN 17:
Line 3, “50 (mm))” should read --50 (mm)).--.

COLUMN 18:
Line 36, “”(R2xcos Θ))])” should read --(R2xcos Θ)).--.

COLUMN 19:
Line 38, “while” should read --while the case where--.

UNITED STATES PATENT AND TRADEMARK OFFICE

CERTIFICATE OF CORRECTION

PATENT NO. : 7,263,315 B2
APPLICATION NO. : 11/183978
DATED : August 28, 2007
INVENTOR(S) : Shigeru Tanaka et al.

It is certified that error appears in the above-identified patent and that said Letters Patent is hereby corrected as shown below:

COLUMN 22:

Line 42, "5 (mm) ≤R1≤15 (mm), and" should read --5(mm)≤R1(mm)≤15(mm), and--.

Line 43, "5 (mm) ≤R2≤15 (mm)." should read --5(mm)≤R2(mm)≤15(mm).--.

Signed and Sealed this

Twenty-fourth Day of June, 2008

JON W. DUDAS
*Director of the United States Patent and Trademark Office*